US006223910B1

(12) United States Patent
Levin et al.

(10) Patent No.: US 6,223,910 B1
(45) Date of Patent: May 1, 2001

(54) DEVICE FOR STORING AND DISPLAYING CAPS

(75) Inventors: Gregg M. Levin, Wayland; Benjamin J. Beck, Boston; Glen V. Walter, Middleton; Ulrike A. Graf, Boston; Jeffrey A. Michael, Cambridge; Samuel B. Breneman, Boston; David G. Harting, Needham; Douglas A. Marsden, Lynnfield, all of MA (US)

(73) Assignee: Perfect Curve, Inc., Sudbury, MA (US)

( * ) Notice: Subject to any disclaimer, the term of this patent is extended or adjusted under 35 U.S.C. 154(b) by 0 days.

(21) Appl. No.: 09/183,766

(22) Filed: Oct. 30, 1998

Related U.S. Application Data

(60) Provisional application No. 60/076,830, filed on Mar. 2, 1998.

(51) Int. Cl.[7] ..... A47F 7/06

(52) U.S. Cl. ..... 211/30; 211/113; 211/207

(58) Field of Search ..... 211/30, 113, 115–119, 211/207–208, 124; D6/315; 24/458, 459, 489, 508, 501; 248/316.1

(56) References Cited

U.S. PATENT DOCUMENTS

| | | | | |
|---|---|---|---|---|
| 494,269 | * | 3/1893 | Coffey | 211/30 |
| 643,317 | * | 2/1900 | Bigger et al. | 24/459 |
| 2,505,403 | * | 4/1950 | Jacobi | 211/30 |
| 2,665,100 | * | 1/1954 | Jason | 211/30 |
| 2,966,711 | * | 1/1961 | Fernberg | 24/459 |
| 3,845,523 | * | 11/1974 | Mayberry | 24/459 |
| 4,673,153 | * | 6/1987 | Hilty et al. | 211/30 |
| 4,773,131 | * | 9/1988 | Koza | 24/459 |
| 4,805,782 | * | 2/1989 | Hale et al. | 211/30 |
| 5,033,660 | * | 7/1991 | Kelly | 211/30 |
| 5,188,325 | * | 2/1993 | Hilty et al. | 211/30 |
| 5,240,123 | * | 8/1993 | Hawk | 211/30 |
| 5,265,737 | * | 11/1993 | Freeby | 211/30 |
| 5,303,829 | * | 4/1994 | Kennedy | 211/30 |
| 5,515,978 | * | 5/1996 | Moran | 211/30 |
| 5,601,197 | * | 2/1997 | Baxter | 211/113 |
| 5,685,465 | * | 11/1997 | Berardis | 211/30 |
| 5,772,049 | * | 6/1998 | Randone | 211/30 |

* cited by examiner

*Primary Examiner*—Daniel P. Stodola
*Assistant Examiner*—Jennifer E. Novosad
(74) *Attorney, Agent, or Firm*—Kirkpatrick & Lockhart LLP

(57) ABSTRACT

A device for displaying and storing baseball-style caps includes a spine-like support to which one or more individual cap supports can be detachably connected and adjusted as to position. The cap supports can be detachably connected and adjusted without requiring detachment or adjustment in the position of other cap holders on the spine. The cap holders support the cap to avoid the distortion of the shape of the cap.

18 Claims, 6 Drawing Sheets

DEVICE FOR STORING AND DISPLAYING CAPS

This application claims benefit of Provisional Appln. No. 60/076830 filed Mar. 2, 1998.

FIELD OF THE INVENTION

The invention relates to a display and storage device for caps having a soft foldable crown.

BACKGROUND OF THE INVENTION

In recent years there has been a rise in the popularity of caps having a soft, foldable crown. Such caps include baseball-style caps, that is, caps having a soft, flexible, generally hemispherical crown and a forwardly extending visor, as well as other styles such as bucket hats which may omit such a visor (all referred to collectively as "caps"). Typically the baseball-style caps include indicia emblematic of a wide variety of affinity groups such as sports teams, schools and the like. Many retail stores maintain a department or section where such caps are displayed. Some retail establishments are devoted primarily to the sale of such caps. In many instances the variety of caps to be displayed is substantial. It is desirable that the caps be displayed efficiently and in an aesthetically pleasing manner. Some establishments may wish to display a plurality of caps in close proximity to each other and in other cases it may be desirable to display the caps in a less dense array and in different display patterns. The ability to store and display such caps also is important to individuals who collect or otherwise maintain a number of different caps. Such users may desire to store their caps in a manner that displays the front of the cap and its indicia.

Various cap storage or display devices have been proposed such as, for example, those described in U.S. Pat. Nos. 5,411,144 (Deupree), 5,566,837 (Lema), 5,624,041 (Van Druff) and 5,630,516 (Helman).

SUMMARY OF THE INVENTION

The invention is embodied in one, and preferably a plurality of, individual cap holders, each holder being adapted to support and retain an individual cap in a manner that provides proper support for the cap while displaying the front of the cap. Each holder is adapted to support and display a cap with the cap being partially-folded so that the rear portion of the generally hemispherical crown lies folded against the interior of the crown. In one aspect of the invention the display and storage device also includes a spine that may be rigid or in the form of a flexible cord, to which one or more of the holders can be detachably connected. A plurality of cap holders can be attached to the spine at selectively spaced locations along the spine to enable variation in the display or storage pattern for the caps. The spine may be mounted in a vertical attitude in which the cap holders are vertically spaced or a horizontal attitude in which the cap holders are horizontally spaced or a combination of horizontal. The spine may be supported on a vertical wall or from an overhead connector to hang freely or may be attached to a self supporting base.

In another aspect of the invention each holder has a crown support on which the partially-folded cap is placed. The crown support is configured to provide a broad area of support to maintain the cap in its proper shape while it is stored in the device. A crown clip overlies the rear portion of the crown support and cooperates with the crown support to grip the folded cap. The cap can be slid into or out of a position between the crown support and the crown clip.

In another aspect of the invention the cap holders are configured to include a spine clamp by which the holder is easily attached to, detached from or slid along the spine. The spine clamp enables the pattern of holders to be varied as desired. The spine clamp can be released to enable adjustment of the vertical position or horizontal orientation about a vertical axis of the cap holder and the cap that it supports. The cap holders also can be mounted in a horizontal array by orienting the spine, or a portion thereof, horizontally. The cap holder includes a transverse channel adapted to detachably receive a horizontally oriented spine. As with the vertically mounted spine, the individual holders can be attached or detached from the horizontally oriented spine without disturbing the position of the other cap holders.

It is among the general objects of the invention to provide an improved device and system for storing and displaying such caps. Also among the objects of the invention are to provide a cap storage and display device for which the arrangement of caps displayed or stored is easily adjustable without requiring repositioning of other caps or cap holders in the display; to provide a cap storage and display device having a large capacity for storage and display of caps without obstructing the front of the caps; to provide a device in which the position and orientation of the caps is easily adjusted and enables infinite adjustment to any position and orientation; to provide a cap storage and display device having individual crown supporting holders in which the cap is easily slipped into or out of a securely retained position on the holder; to provide a cap storage and display device that can be placed in any location and to provide improved methods for storing and displaying such caps.

BRIEF DESCRIPTION OF THE DRAWINGS

The foregoing and other objects and advantages of the invention will be appreciated more fully from the following further description thereof, with reference to the accompanied drawings wherein.

DESCRIPTION OF THE ILLUSTRATIVE EMBODIMENT

Figure 1:
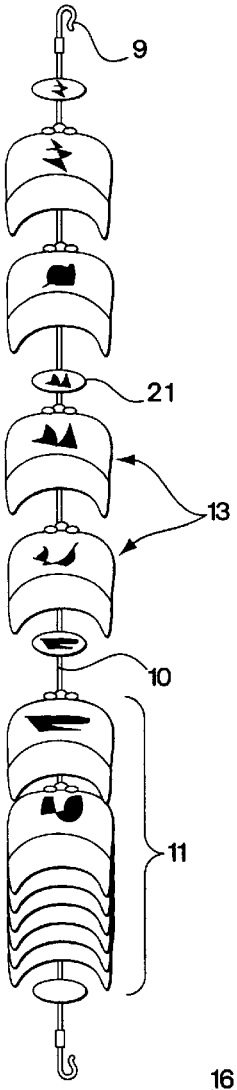
FIG. 1 is an illustration of the device in which a plurality of baseball-style caps, supported by cap holders are connected to a vertically oriented spine.
Figure 1A:
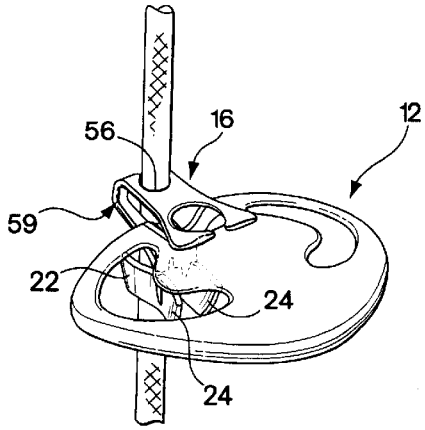
FIG. 1A is an illustration of a single cap holder attached to a portion of a vertical spine.

FIG. 1 illustrates one configuration of the invention in which the device may be oriented to support a plurality of caps in a vertical array. The device includes an elongate spine 10 to which one or more cap holders 12 may be detachably connected. Each of the holders 12 preferably is constructed to enable it to be attached to or detached from the spine 10 without adjusting or changing the position of any of the other holders in an array. In one embodiment the spine is flexible and may be in the form of a flexible cord or rope. Alternately, the spine 10 may be the form of a rigid rod, for example, where it is desirable that the device be self supporting. When the device is used in a vertical array, it may be secured simply by attaching the upper end of the spine 10 to a suitable support. At least one, and preferably both ends of the spine 10 may be secured to a hook 9 to facilitate attachment of the spine to a suitable support in a variety of modes. The spine 10 may be attached to a wall or other vertical surface, such as the back of a door, or may be freely suspended from a closet pole, ceiling or other overhead structural support. Although FIG. 1 illustrates the cap holders as all facing forwardly, the cap holders 12 and spine 10 are constructed to enable the holders to face in any horizontal direction about the vertical spine as well to enable the vertical position of the cap holders to be adjusted, preferably in an infinite manner to provide the desired spacing and orientation for the supported caps. FIG. 1 illustrates several groups of caps including a lower group 11 in which the holders 12 associated with the caps are located in a relatively close relation to each other so that the group of caps can be vertically compacted in a nested configuration, as when it is desired to use the device in a maximum density storage mode. The caps, and their associated holders shown in FIG. 1 above the lower group 11 illustrate the manner in which the caps may be spaced so that each is displayed in a desired spacing, for example, to permit the indicia or symbol in the front of the cap to be displayed.

As shown in further detail in FIGS. 3–7 the cap holder 12 may be considered as having a crown support 14 that is adapted to engage the underside of a partially-folded cap 13. For ease of explanation the portion of the cap holder 12 that extends toward the front of a caps supported on the holder will be referred to as "front end" or "forwardly", and the opposite direction being referred to as "back" or "rearward". The lateral width of the crown support 14 and the extent to which it projects forwardly is selected to provide a firm, broad area of support for the major portion of the partially-folded cap sufficient to maintain the cap shape. In the preferred embodiment the crown support 14 is wider in its rearward portion than in its more forward portion. In the illustrative embodiment the crown support 14 may be considered to be approximately triangular with rounded and curved edges. The cap should be supported so that it will not deform under the influence of its own weight. The crown support preferably is formed to define a convex upper surface 15 adapted to provide shape-retaining support for the cap. The crown support may, if desired, be formed with one or more apertures 17, dependent, in part, on the material of manufacture. The apertures 17 may enhance the economy of manufacture in that less material is required to make the crown support 14 and may enhance air circulation about the folded portion of the crown.

The cap holder 12 also includes a clip, indicated generally at 16 that has a portion that overlies the rear portion of the crown support 14 and cooperates with the crown support 14 to grip the rear marginal region of the partially-folded cap. The clip 16 also may be formed to include a configuration by which the cap holder 12 can be attached to , detached from or stabilized with respect to the spine 10. In the illustrative embodiment, both the crown support 14 and the clip 16 may be injection molded from a suitable plastic material and may be configured so that they can be formed separately and then secured together in order to function cooperatively as a single, integral unit. The principles of the invention may, however, be incorporated into a cap holder formed from other materials such as metal, wood or the like.

Figure 4:
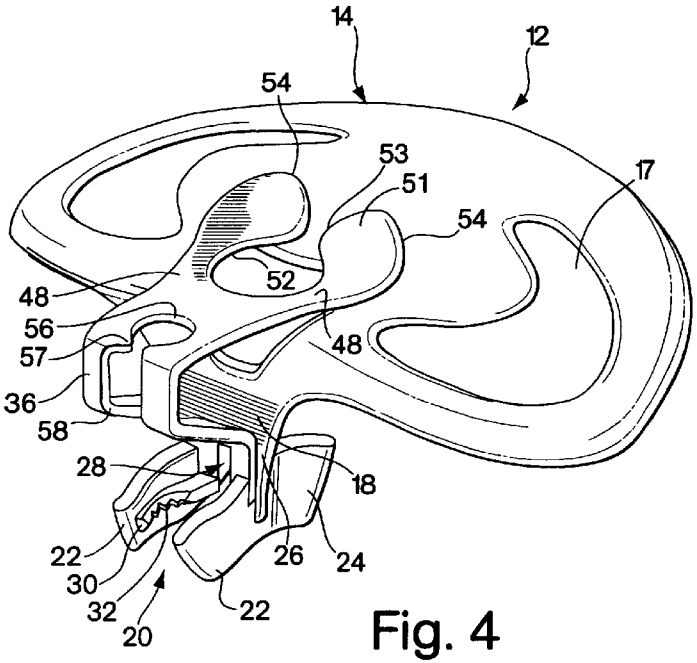
FIG. 4 is a an isometric illustration of the cap holder as seen from a rear quarter.
Figure 3:
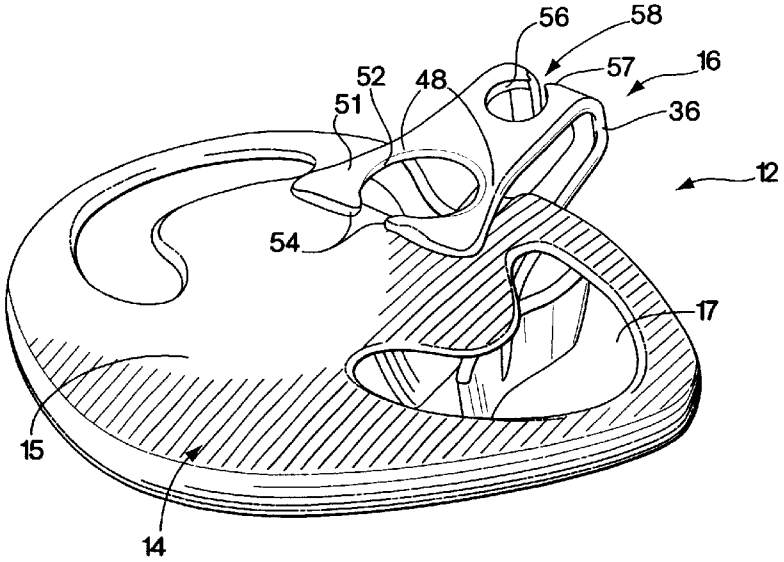
FIG. 3 is an isometric illustration of an embodiment of a cap holder as seen from a front quarter.
Figure 5:
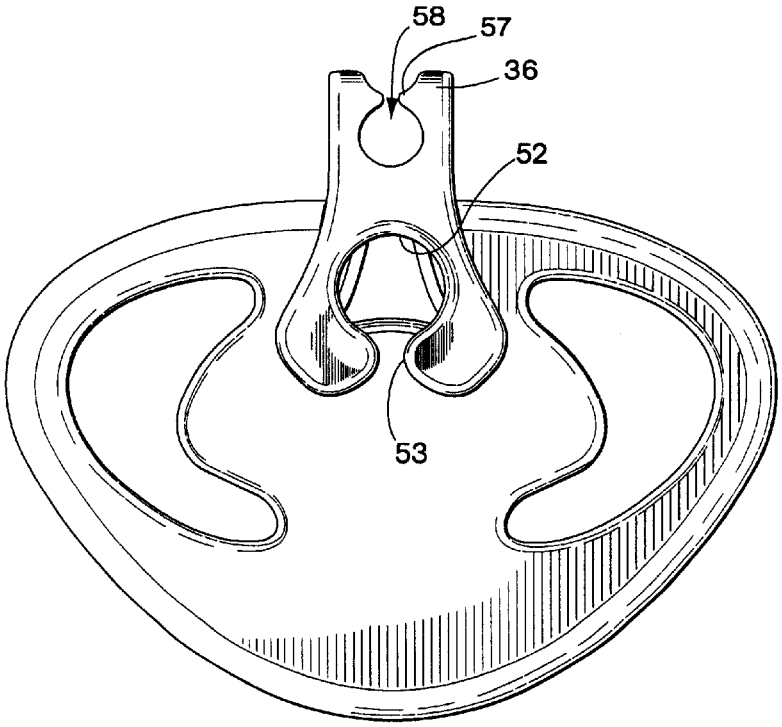
FIG. 5 is a plan view of a cap holder of FIGS. 3 and 4.
Figure 6:
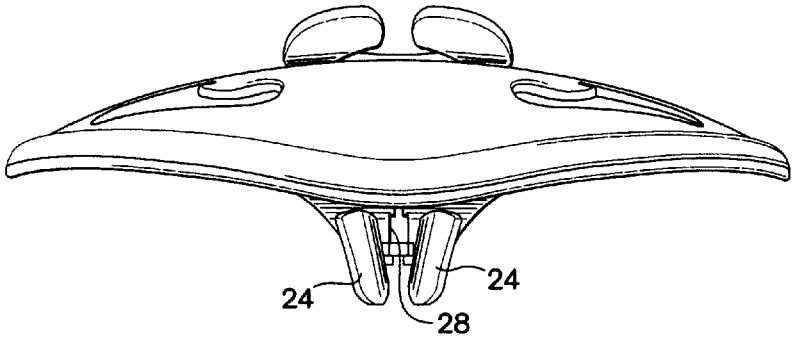
FIG. 6 is a front view of the holder of FIG. 3 and 4.
Figure 7:
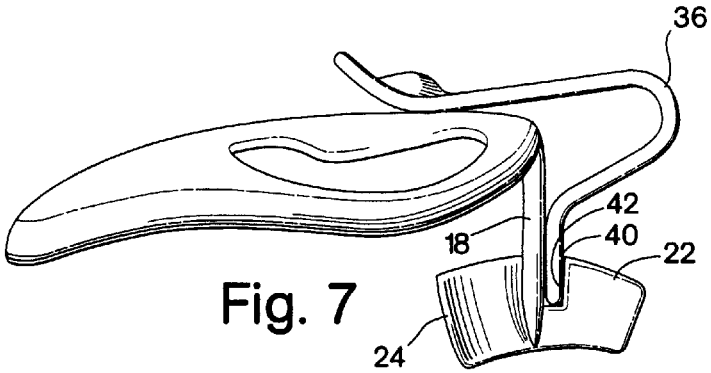
FIG. 7 is a side view of the holder FIG. 3 and 4.
Figure 8:
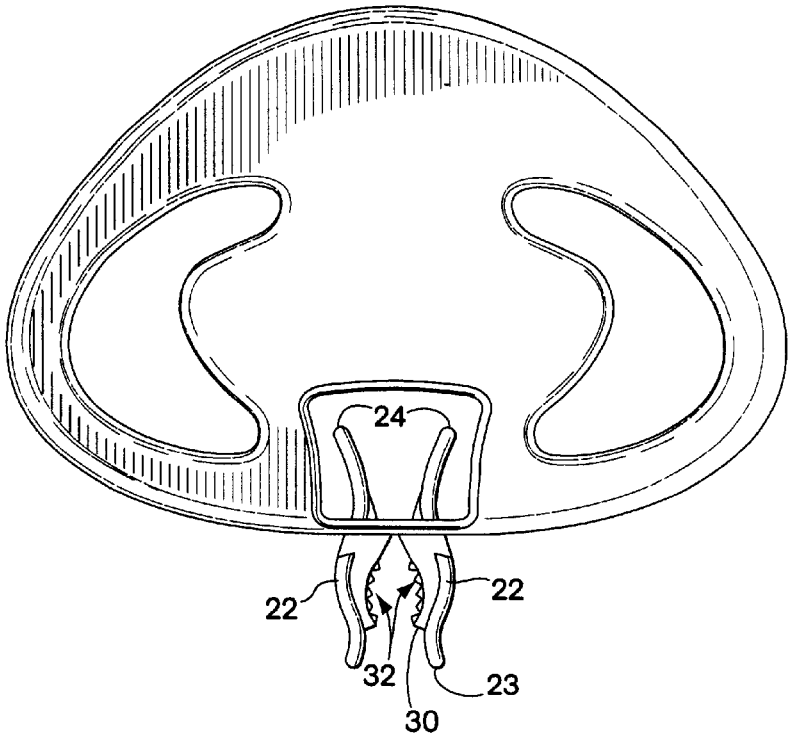
FIG. 8 is a plan view of the main the holder before attachment of the clip.

As shown in FIGS. 4 and 7, the crown support 14 may include a downwardly depending bracket 18 that supports a spine clamp 20 as well as a region to facilitate attachment of the clip 16 to the crown support 14. In the illustrative embodiment the spine clamp 20 is integrally molded with the bracket 18, preferably at the lower end of the bracket 18. The spine clamp 20 includes a pair of rearwardly projecting jaws 22, adapted to grip a vertical spine, and a pair of forwardly projecting, manually grippable tabs 24. The jaws 22, tabs 24, and the bracket 18 are formed to allow for some resilient, flexible movement of the jaws 22 away from or toward each other in response the manual squeezing or releasing, respectively, of the tabs 24. To that end, the lower portion of the downwardly depending bracket 18 may be formed to define bifurcated jaw mounts 26, each of which is formed integrally with one jaw 22 and one tab 24. The bifurcated jaw mounts 26 are defined by a heightwise extending slot 28 formed in the bracket 18 by which the bifurcation is defined. Each of the jaw mounts 26 is resiliently twistable. The polymeric material from which the crown support 14 and spine clamp 20 are molded is selected to effect a firm grip on a vertically oriented spine 10 when the tabs 24 are released. The jaw mounts 26 should be sufficiently flexible so that when the tabs 24 are squeezed together the jaws 22 release sufficiently from the spine 10 to enable the crown support 12 to be detached from the spine 10. The jaws 22 may be provided with spine-engaging surfaces 30 at the inwardly facing surfaces of the jaws 22 to facilitate secure engagement with the vertical spine 10. In the illustrative embodiment shown in FIGS. 8 and 9, the inwardly facing surface 30 may be provided with inwardly facing serrations 32 arranged to grip the spine 10. The serrations are adapted to grip securely a spine 10 that is formed from a flexible rope as well as a more rigid structure such as a rod or tubular spine.

Figure 9:
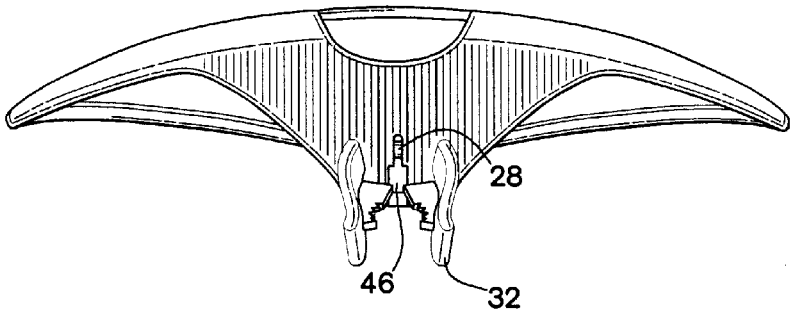
FIG. 9 is a rear view of the holder component of FIG. 8.
Figure 10:
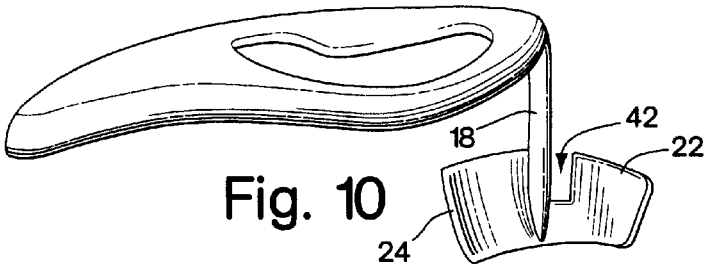
FIG. 10 is a side illustration of the component of FIG. 8.
Figure 12:
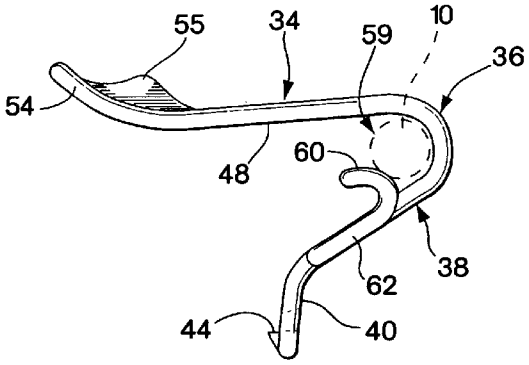
FIG. 12 is a side elevation of the clip of FIG. 11.
Figure 14:
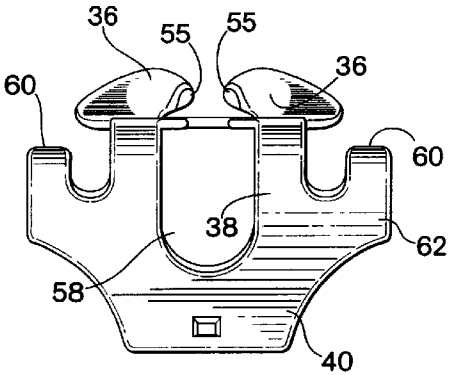
FIG. 14 is a rear elevation of the clip.
Figure 11:
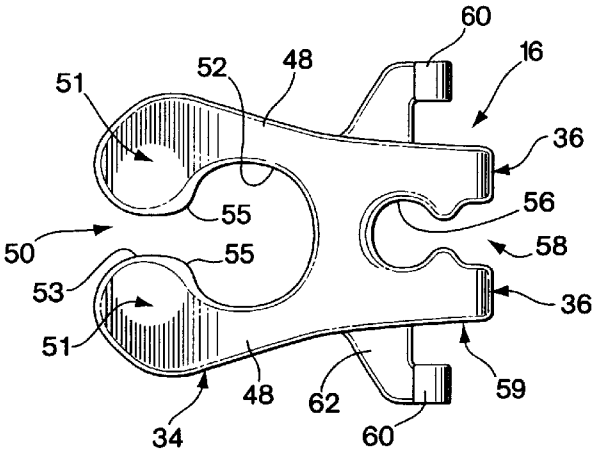
FIG. 11 is a plan view of a clip component of the cap holder modified in some respects from that shown in FIGS. 3–7.
Figure 13:
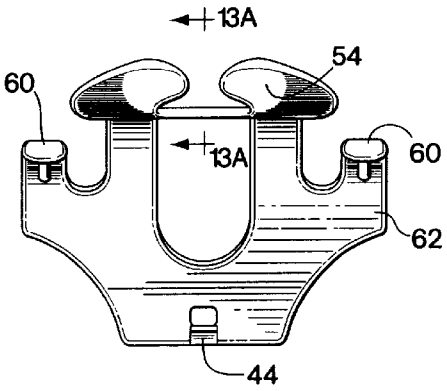
FIG. 13 is a front elevation of the clip.
Figure 15:
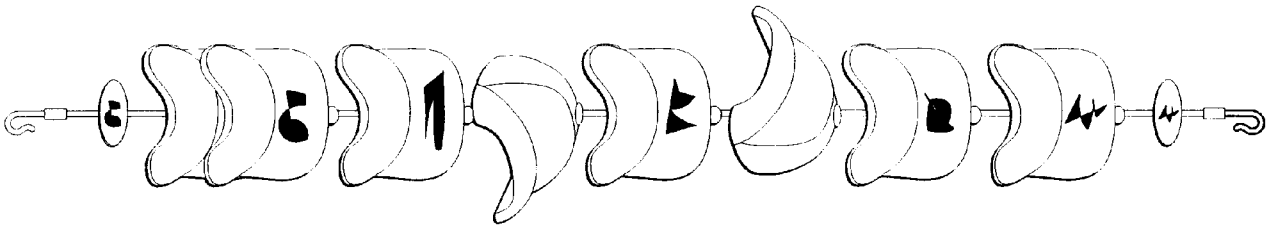
FIG. 15 is an illustration of a plurality of baseball-style caps attached to a vertical support in which the horizontal orientation of the caps is selectively varied.

The tabs 24 diverge in a forward direction to provide a comfortable configuration for squeezing the tabs 24 between the users fingers. The rearward ends of the jaws 22 preferably are slightly flared, indicated at 23, to facilitate entry of a vertical spine 10 into and between the jaws 22. When the tabs 24 are squeezed together the jaw mounts 26 of the bracket 18, to which the jaws 22 and tabs 24 are attached, will twist to enable the jaws 22 to resiliently separate. Upon release of the tabs 24, the jaws 22 will close to their spine-gripping configuration. 15 The clip 16 shown, before attachment to the crown support 14, in FIGS. 11–14 and includes a generally horizontal forwardly extending upper portion 34 that merges into a rear bight 36 that, in turn, merges into a forwardly and downwardly extending lower portion 38. In the illustrative embodiment, the lower portion 38 of the clip includes a downwardly extending segment 40 by which the clip 16 can be attached to the downwardly depending bracket 18 of the crown support 14. The arrangement for attaching the clip 16 to the crown support 14 may include, for example, the use of a snap fit connection. To that end the jaws 22 may include a portion that is spaced from the rear face of the bracket 18 to define a pair of slots 42 (See FIGS. 7 and 10). The slots 42 are configured to receive the lateral regions of the downwardly extending segment 40 of the clip 16 in a sufficiently close fit to stabilize the position of the clip with respect to crown support 14. In order to secure the clip 16 in place, the clip may be provided with a latch that includes forward projection 44 that can slide downwardly along the rearwardly facing surface of the bracket 18 into engagement with a detent notch 46 (FIG. 9). The dimension defined by the thickness of the downwardly extending segment 40 of the clip 16 and projection 44 is slightly greater than the width of the slots 42 in order to require some elastic deformation of the materials as the segment 40 of the clip 16 is slid downwardly into the slots 42. The detent notch 46 and the projection 44 are located so that when the downwardly extending segment 40 has been inserted at or close to the bottom of the slots 42, the projection 44 will snap into the detent notch 46. The parts can be assembled simply without requiring special tools, fixtures or the like. It should be understood that although the presently preferred embodiment of the invention employs a snap-fit connection between the clip 16 and crown support 14, other techniques may be employed for securing the parts together. For example only, the components may be riveted together, such as by heat staking, or may be secured to each other by adhesive or other conventional means. The material from which the components are made may affect the choice of means or techniques for securing the parts together.

The upper portion 34 of the clip is bifurcated at its forward end to define a pair of forwardly extending fingers 48. The fingers 48 are separated by a key-hole slot 50 that includes a button hole 52 adapted to receive the cap button 17 (FIG. 2) present at the top of most caps. The forward ends of the fingers 48 define a pair of pads 51 having forward edges that are flared upwardly, at 54, to define a gradual, smooth entry into which the folded edge 15 of the cap can be inserted smoothly, without binding. With those caps having a button 17, the upward flare 54 of the fingers 48 provides a smooth lead-in by which the button can engage the undersides of the fingers 48 and be advanced into a position within the button hole 52. In the embodiment of the clip 16 shown in FIGS. 11–14, the more forwardly disposed forward portions of the button hole 52 defined by the rear portions of the pads 5 1, adjacent the transition from the button hole 52 to the more narrow slot 53 are flared upwardly and rearwardly to define a smooth lead-out 55 to permit the cap button 17 to slide forwardly under the pads 51 in a smooth, progressive action, avoiding binding of the button. The cap button hole 52 preferably is dimensioned to be larger in diameter than the most commonly employed cap buttons. A cap button hole 50 approximately ⅝ inch in diameter should be adequate to receive most cap buttons. The clip is mounted so that the forward fingers 48 of the clip overlie the upper surface of the crown support, in close proximity so that the pads 51 at the ends of the fingers 48 can grip the partially-folded cap and clamp it against the crown support 14. The partially folded cap preferably is gripped by the device only in the region of double thickness material of the folded crown. The large size of the button hole 52 enables the cap to be so gripped.

The materials from which the device is made, and particularly from which the clip 16 and fingers 48 is made, preferably should be selected to minimize material creep that could adversely affect, over time, the gripping force between the fingers and cap support. Should a cap be stored in a cap holder for an extended period of time, the existence of material creep could result in a loss of gripping power of the fingers. For example, in the preferred embodiment, the cap support may be formed from polypropylene and the clip, including the fingers, may be formed from polymeric material available from General Electric Company under the trade designation Noryl, preferably in grades 731 or SEI.

The rearward portion of the clip 16 is configured to include a stabilizing hole 56 in the rear of the upper portion 34 of the clip. A slot 58, receptive to a vertical spine, also is formed in the bight 36 and lower portions, 38 of the clip 16. When the clip 16 is attached to the crown support, the stabilizing hole 56 will be aligned vertically with the jaws 22. That enables the assembled cap holder 12 to be attached to a vertically oriented spine 10 by urging the device rearwardly into engagement with the vertical spine 10. In so doing, the spine 10 enters the slot 58 and the resiliently spread jaws 22 while also entering the stabilizing hole 56. The juncture of the stabilizing hole 56 and the slot 58 may be provided with inwardly extending projections 57 to narrow the entry slot into the stabilizing hole 56. That assures that the stabilizing hole can be snapped onto the spine 10. So attached, the cap holder 12 will be maintained in a position in which the crown support 14 extends forwardly, generally perpendicular to the axis of the spine 10. The stabilizing hole 56 preferably is dimensioned with respect to the spine to permit the cap holder 12 to slide up and down the spine while the tabs 24 are squeezed to lighten or release the grip of the jaws 22 on the spine.

Figure 2:
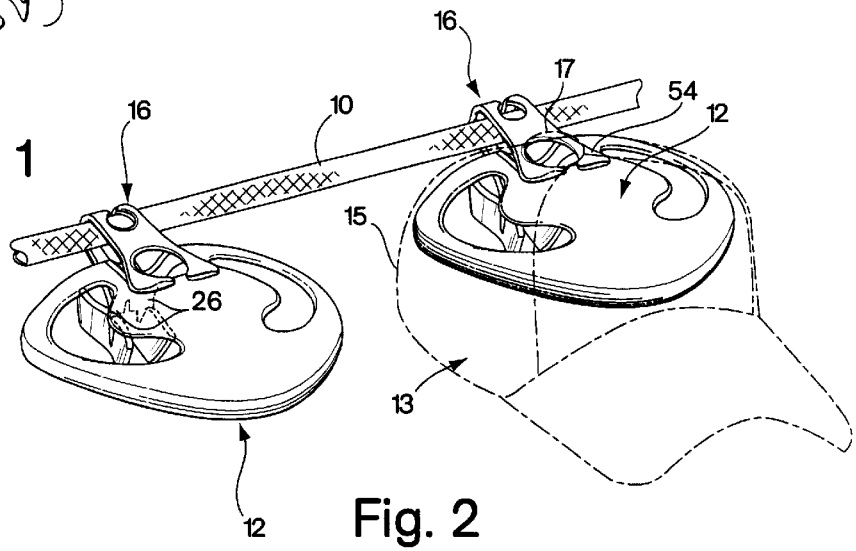
FIG. 2 is an illustration of a pair of cap holders mounted on a horizontal spine.

The clip 16 also may be constructed to include an arrangement by which the cap holder 12 can be attached to a horizontally oriented spine as suggested in FIG. 2. To that end, the clip 16 may be adapted to receive a horizontally oriented spine 10 in a channel 59 defined transversely through the bight 36 portion of the clip 16. The clip 16 may be provided, as suggested in FIGS. 11 - 14, with a pair of spine retainers 60 that extend from the lower portion 38 of the clip toward the upper portion 34 of the clip. In order to enhance the lateral stability of a horizontally mounted device, the spine retainers 60, when used, preferably are formed on transverse extensions 62 formed integrally with the portions 38 of the clip 16. The spine retainers 60, preferably are spaced from the bight 36 of the clip to cooperate with the bight 36 to embrace a horizontal spine 10 about an arc greater than 180°, as suggested in FIG. 12. The space defined by the bight 36 and the spine retainers 60 is configured with respect to the spine to enable the cap holder 12 to be mounted snugly on the horizontal spine. When the spine is mounted on a wall, the rearwardly facing portions of the clip 60 can bear against the wall to further stabilize the attitude of the cap holder 12 in a generally horizontally projecting attitude. The cap holder 12 can be connected to or detached from a horizontally oriented spine by passing the spine between the crown support and the fingers 48 the clip, until the horizontal spine is captured within the bight 36 of the clip. The spine may be formed to have both horizontal and vertical sections so that some of the caps can be arranged in a horizontal array while others can be arranged in a vertical array. In a flexible spine, such as in the form of a cord, the cord may be attached to the wall or other supporting surface to provide both horizontal and vertical components.

Although the invention has been described in the context of displaying or storing a plurality of caps, it should be understood that the cap holder of the present invention could be attached to a very short spine, adapted to retain only a single cap holder. The spine, when formed from a flexible cord or the like, preferably is provided with a connector, such as a hook 9 at one or both ends of the spine 10. The hook may facilitate hanging of the upper end of the spine from the ceiling or from a fastener on a wall or forming a loop with the spine that can be suspended from a closet pole.

Figure 16:
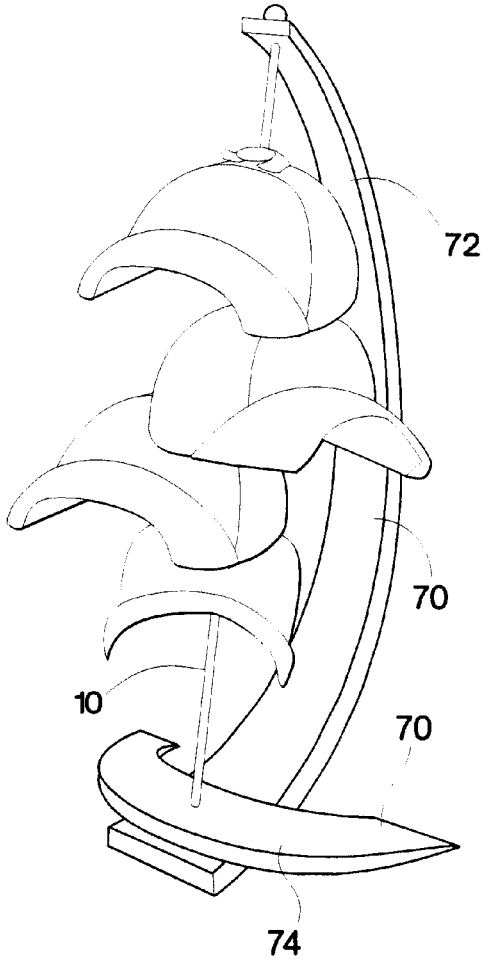
FIG. 16 is an illustration of a stand-alone display rack in which a plurality of the caps are supported in a vertical array with the caps facing horizontally in different directions.

In alternate uses, the spine may be mounted on a table top or counter display by providing a self supporting frame to hold the spine in a vertical position. FIG. 16 illustrates one representative embodiment of a self standing display as may be used at a point of purchase location. The arrangement may include a frame, indicated generally at 70 that may have a vertical support 72 attached to and extending upwardly from a horizontal base 74. The spine 10 is attached at its upper and lower ends to the upper end of the frame 70 and the lower region of the frame 72 or base 74. The vertical support 72 may be arched, as shown, to define a bow-shaped arrangement together with the spine 10, thereby providing space to enable the horizontal direction of the cap holders to be varied about the vertical spine 10.

The device is easy to use. After the cap is partially folded, it is placed on the crown support and its rearward margin, defined by the fold line 8, is slipped rearwardly between the crown support and the fingers 48. The flared forward edges of the tabs serve as a lead-in to facilitate entry of the cap, including caps having a button 17 on the top of the crown. The folded cap may be attached to the cap holder before or after the cap holder is attached to a vertical spine. In either case, the cap holder is attached to a vertical spine by gripping the tabs 24 of the cap holder and squeezing them to spread the jaws sufficiently to receive the spine. The spine also is inserted into the stabilizing hole 56. Depending on the manner in which the spine is supported, the cap holders may be oriented at various rotational positions about the axis of the spine so that selected caps can face horizontally in different directions. When the spine is mounted against a wall or other vertical surface, the fronts of the caps will all face in the same direction, as suggested in FIG. 1. The position of the cap holders and their supported caps can be adjusted longitudinally along the spine to permit the caps to be nested in a compact configuration or to permit them to be spaced as desired, to display the indicia at the front of the crown. The spine also permits attachment of markers as may be used in a retail establishment to display price, size or other characteristics associated with the caps.

From the foregoing it should be appreciated that the invention provides a versatile system for displaying and storing caps in a variety of configurations with the caps being supported to maintain their shape. The cap holders are connectable to a common support and may be positioned and oriented, individually, as desired. Individual cap holders can be attached, detached or repositioned without requiring that the position of any of the other caps holders be modified. The device can be made out of different materials and different colors, as may be desirable to coordinate with colors associated with a particular sports team, college, company or the like. The cap supports 14 may provide a broad area to which selected indicia, logos or decals can be applied. It should be understood, however, that the foregoing description of the invention is intended merely to be illustrative and that other modifications, embodiments and equivalents within the scope of the invention may be apparent to those skilled in the art.

Having thus described the invention what we desire to claim and secure by Letters Patent is:

1. A cap supporting device comprising:

an elongate spine, at least one cap holder adapted to support a cap from beneath the crown of the cap with the front of the crown facing generally forwardly to expose the front of the crown, the cap holder including a crown support having an upper surface shaped to support a crown of a partially folded cap, the horizontal dimensions of the support surface being sufficient to contact and support the partially folded cap over an area sufficiently broad to resist deformation of the shape of the cap under the influence of the weight of the cap;

a crown clip having a portion mounted above the crown support and being biased downwardly toward the crown sup port for cooperating with the crown support to grip the crown;

wherein the crown clip comprises a pair of forwardly extending fingers biased toward the crown support, the region between the fingers defining a hole and a narrow slot extending forwardly from the hole.

2. A device as defined in claim 1 wherein the hole is receptive to a button on the crown of the cap and where the fingers have ends that are shaped to form pads, the forward edges of the pads having an upward flare.

3. A device as defined in claim 2 further comprising:

the rear edges of the pads having an upward flare.

4. A device as defined in claim 1 wherein the crown support defines a convex upper surface.

5. A device as defined in claim 4 wherein the crown support is wider at its rear portion than at its more forwardly disposed portion.

6. A device as defined in claim 1 wherein the support surface is approximately triangularly shaped.

7. A device as defined in claim 1 further comprising:

each cap holder having a spine clip at its rear portion, the spine clip being detachably connectable to the spine.

8. A device as defined in claim 7 wherein the spine clip is selectively connectable to either of a vertically or horizontally oriented portion of the spine.

9. A cap supporting device comprising an elongate spine;

at least one cap holder adapted to support a cap from beneath the crown of the cap with the front of the crown facing generally forwardly to expose the front of the crown;

a rearward portion of said at least one cap holder having a connector detachably connectable to the spine, the connector being constructed to enable the location of said at least one cap holder on the spine to be selected independently of the location of the other cap holders, the connector having a pair of rearwardly facing jaws adapted to normally clamp to a vertically oriented portion of the spine, the jaws being separable to release their grip on the spine to enable the position of the cap holder to be adjusted along the spine.

10. A device as defined in claim 9 being formed from a flexible plastic material and wherein the jaws are integral with a resiliently flexible portion of the cap holder, the jaws being separable in response to flexing of the resiliently flexible portion.

11. A device as defined in claim 9 further comprising:

a stabilizing member vertically aligned with the jaws engageable with the spine at a location spaced vertically from the jaws, whereby the device may be attached at two locations on the spine to stabilize the device on the spine.

12. A device as defined in claim 9 wherein the jaws are mounted to a flexible portion of the cap holder, the device further comprising a pair of forwardly extending tabs connected with the jaws, the connection between the tabs and the jaws is constructed to cause the jaws to resiliently separate in response to squeezing of the tabs together.

13. A device as defined in either one of claims 1 or 9 wherein the spine is flexible.

14. A device as defined in either one of claims 1 or 9 wherein the spine is rigid.

15. A cap holder comprising:

a crown support having an upper surface shaped and having sufficient width and depth to receive and support a partially-folded crown of a cap, a crown clip overlying the crown support and adapted to cooperate with the crown support to grip the crown of a cap supported by the crown support;

wherein the crown clip comprises a pair of forwardly extending fingers overlying the upper surface of the crown support, the fingers having downwardly facing pads at their forward ends, the clip having a hole formed between the fingers rearwardly of the pads that is receptive to a crown button.

16. A cap holder as defined in claim 15 wherein the upper surface of the crown support is convex.

17. A cap holder as defined in claim 15 further comprising:

each of the pads having a forward edge that is flared upwardly to provide a smooth entry between the fingers and the crown support.

18. A cap holder as defined in claim 17, further comprising:

the rearward portions of the pads being flared upwardly to provide a smooth lead-in from the hole towards the forward end of the cap holder.

* * * * *